US005433295A

United States Patent [19]

Murphy

[11] Patent Number: 5,433,295

[45] Date of Patent: Jul. 18, 1995

[54] INDICATING ELEMENT FOR ELEVATORS

[75] Inventor: James L. Murphy, Streamwood, Ill.

[73] Assignee: Inventio AG, Hergiswil NW, Switzerland

[21] Appl. No.: 271,555

[22] Filed: Jul. 7, 1994

Related U.S. Application Data

[63] Continuation of Ser. No. 13,757, Feb. 4, 1993, abandoned.

[51] Int. Cl.[6] ..... B66B 3/00

[52] U.S. Cl. ..... 187/397; 187/398; 345/32; 345/44

[58] Field of Search ..... 187/121, 122, 124, 127, 187/130, 135, 137, 139, 133, 396, 397, 398, 399; 345/32, 44

[56] References Cited

U.S. PATENT DOCUMENTS

| | | | |
|---|---|---|---|
| 3,675,242 | 7/1972 | Hammell | 340/381 |
| 3,918,052 | 11/1975 | Bricher . | |
| 4,302,798 | 11/1981 | Sit . | |
| 4,628,422 | 12/1986 | Ewald | 362/240 |
| 4,726,449 | 2/1988 | Orndorff et al. . | |
| 4,805,739 | 2/1989 | Lind et al. . | |
| 4,832,157 | 5/1989 | Kitno . | |
| 4,924,974 | 5/1990 | Orndorff et al. . | |
| 5,039,832 | 8/1991 | Polacek et al. | 200/317 |
| 5,043,716 | 8/1991 | Latz et al. | 340/782 |
| 5,136,287 | 8/1992 | Borenstein | 340/925 |
| 5,379,865 | 1/1995 | Berdich et al. | 187/398 |

FOREIGN PATENT DOCUMENTS

| | | | |
|---|---|---|---|
| 0104848 | 4/1984 | European Pat. Off. . | |
| 0392863 | 10/1990 | European Pat. Off. . | |
| 0406845 | 1/1991 | European Pat. Off. . | |
| 524428 | 1/1993 | European Pat. Off. | 187/130 |
| 2652433 | 3/1991 | France . | |
| 9102425 U | 6/1991 | Germany . | |
| 1-252474 | 10/1989 | Japan | 187/130 |
| 420491 | 1/1992 | Japan . | |
| 4-333479 | 11/1992 | Japan | 187/135 |

OTHER PUBLICATIONS

Archer Semiconductor Reference Guide, 1987 Edition p. 15, F336HD Blinking LED.

*Primary Examiner*—Thomas M. Dougherty
*Assistant Examiner*—Robert Nappi
*Attorney, Agent, or Firm*—Howard & Howard

[57] ABSTRACT

An indicating element for an elevator includes a cover plate having an opening formed therein through which a lens extends. Positioned behind the lens is a light diffuser having an area formed in the shape of a symbol to be displayed. A plurality of light emitting diodes are mounted on a front surface of a printed circuit board and the diodes extend into the diffuser. The front surface of the printed circuit board, as well as the side walls of the diffuser are white to achieve a better light reflection. The lens, the diffuser and the printed circuit board are mounted on studs extending from a rear surface of the cover plate and are retained by nuts. The light emitting diodes are connected together in separate groups with a first switch for connecting the groups in series to a higher voltage alternating current power supply and a second switch for connecting the groups in parallel to a lower voltage direct current power supply.

20 Claims, 2 Drawing Sheets

INDICATING ELEMENT FOR ELEVATORS

This application is a continuation of U.S. patent application Ser. No. 08/013,757, filed Feb. 4, 1993 and now abandoned.

BACKGROUND OF THE INVENTION

The present invention relates generally to an indicating apparatus for elevators and, in particular, to a modular element for indicating information to elevator passengers.

There is shown in the European patent application 92110333.9, which claims priority from the U.S. patent application Ser. No. 07/736,084 owned by the assignee of the present application, an indicating element which utilizes light emitting diodes instead of incandescent bulbs for the presentation of symbols, such as for instance arrows of direction of travel. Light emitting diodes are arranged in an arrow shape on a printed circuit board mounted on a lens carrier. The diodes extend into lens housings of arrow shape into which lenses are fitted on the lens carrier. On the indicating side, the indicating element is closed by a filter plate.

A disadvantage of the above described indicating element is the complicated construction of the symbols to be presented. The lens housings in the shape of symbols or portions of symbols are attached to or molded with the lens carrier and surround the lenses which is an expensive and costly process of manufacture. Furthermore, only one symbol can be presented with this type of construction since the diodes and the lens housings are fixed in the shape of the symbol to be displayed.

SUMMARY OF THE INVENTION

The present invention concerns an apparatus for indicating information to elevator passengers. The apparatus is an indicating element including a printed circuit board having a front surface; a plurality of light emitting diodes for indicating information mounted on the front surface of the printed circuit board; a diffuser positioned in front of the light emitting diodes for guiding light from the light emitting diodes and for forming the light into a symbol to be displayed; and a lens positioned in front of the diffuser through which the light in the form of a symbol is transmitted to a passenger. Also mounted on the printed circuit board is means for selectively connecting the light emitting diodes to a power supply, groups of the light emitting diodes being connected in series for use with an alternating current power supply and in parallel for use with a direct current power supply. The indicating element is modular in construction since each of the lens, the light diffuser and the printed circuit board are removably retained on studs extending from a cover plate and can be easily replaced to provide for different symbols and different colors of light.

The present invention solves the problems and eliminates the drawbacks associated with known indicating devices by providing an indicating element of modular design in which different symbols can be presented at an illumination level of incandescent bulbs and the symbols can be replaced easily by substituting diffusers and/or printed circuit boards.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
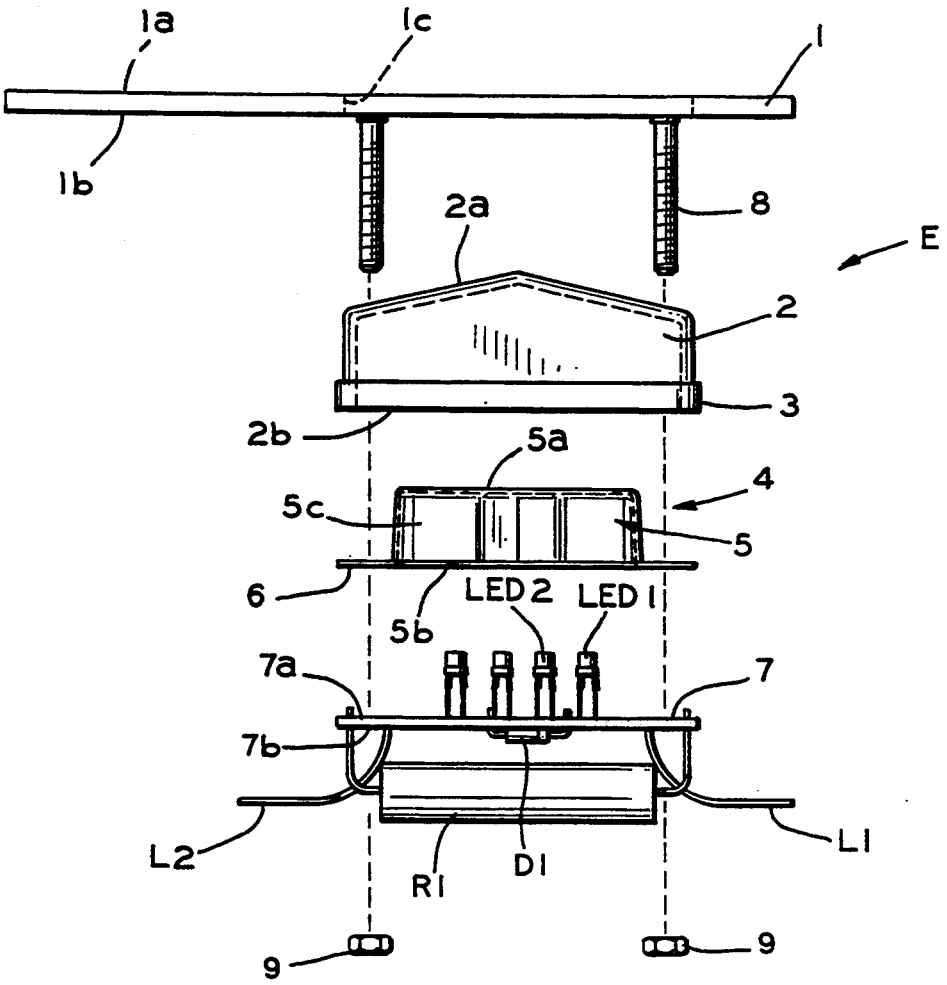
FIG. 1 is an exploded top plan view of an indicating element in accordance with the present invention.
Figure 2:
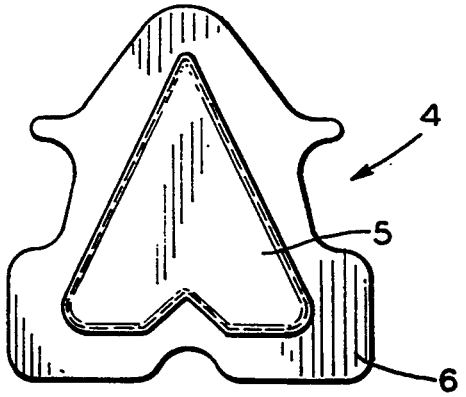
FIG. 2 is a front elevation view of the light diffuser in the indicating element shown in the FIG. 1.

There is shown in the FIG. 1 an indicating element E including a cover plate 1 having a front surface 1*a*, a rear surface 1*b* and an opening 1*c* formed therein into which a lens 2 can be inserted from the rear surface 1*b* of the plate 1. The lens 2 is cup shaped with a closed forward end 2*a* which will extend beyond the front surface 1*a* of the plate 1 and with an open rearward end 2*b* having an outwardly extending flange 3 formed thereabout. A light diffuser 4 extends partially into the open end 2*b* of the lens 2. The diffuser 4 has a cup shaped body 5, which body is formed in the shape of a symbol to be presented such as an upwardly pointing arrow as shown in the FIG. 2, and an outwardly extending flange 6 formed thereabout. In a manner similar to the lens 2, the body 5 is formed with a closed forward end 5*a* and an open rearward end 5*b* about which the flange 6 is formed. In order that the light radiated by the lens 2 at the front surface la appears as white light to the observer and without shadows, the light diffuser 4 can be formed of a transparent or translucent polycarbonate material with a white tint.

Figure 3:
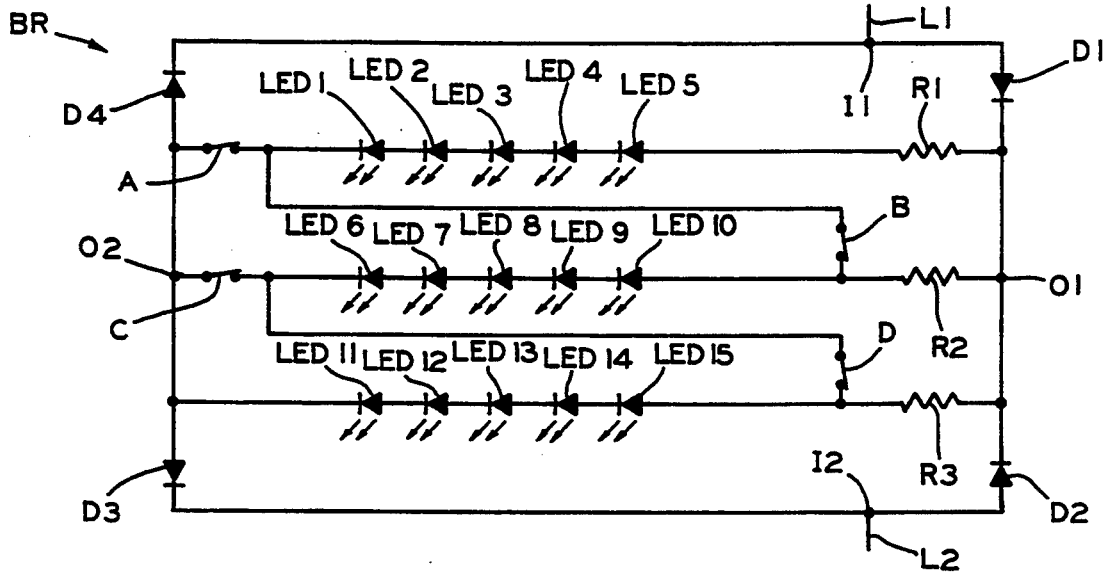
FIG. 3 is a schematic diagram of the electrical circuit of the indicating element shown in the FIG. 1.

The devices of the electrical circuit shown in FIG. 3 are mounted on a printed circuit board 7. The printed circuit board 7 has a plurality of light emitting diodes (LED's) LED1 through LED15 mounted on a front surface 7*a* thereof. Only the LED1 and the LED2 are identified in the FIG. 1. When the front surface 7*a* of the board 7 is abutted against the flange 6, the LED's extend into the interior of the light diffuser 4. The LED's typically emit light with a wavelength of approximately 590 nanometers (nm) but, depending on the desired color, green, red or other color LED's can be used. A plurality of switches A, B, C and D; a plurality of resistors R1 through R3; a plurality of diodes D1 through D4; and a pair of connecting wires L1 and L2 are mounted on a rear surface 7*b* of the printed circuit board 7. Only the resistor R1, the diode D1 and the wires are shown in the FIG. 1. The front surface 7*a* of the board 7 and an inner surface of a side wall 5*c* of the light diffuser body 5 can be coated with a white reflective material such as paint for better reflection of light. Two pairs of threaded bolts or studs 8 extend from the rear surface 1*b* of the cover plate 1 for mounting the lens 2, the light diffuser 4 and the printed circuit 7. The lens 2, the light diffuser 4 and the printed circuit 7 each have two pairs of apertures (not shown) formed therein through which the studs 8 pass and each threadably engage a nut 9.

The schematic electrical circuit diagram of the FIG. 3 shows a first group of the LED's, the light emitting diodes LED1 through LED5, connected in series; a second group of the LED's, the light emitting diodes LED6 through LED10, connected in series; and a third group of the LED's, the light emitting diodes LED11 through LED15, connected in series. The three groups of LED's are connected in parallel at the output of a full wave bridge rectifier circuit BR formed by the diodes D1 through D4. The bridge circuit has a first input terminal I1 connected to the wire L1, an anode of the diode D1 and a cathode of the diode D4. The bridge circuit has a second input terminal I2 connected to the wire L2, an anode of the diode D2 and a cathode of the diode D3. The wires L1 and L2 can be connected to a power supply (not shown) such as a source of 120 volts AC. The bridge circuit has a first output terminal O1 connected to a cathode of each of the diodes D1 and D2. The bridge circuit has a second output terminal O2 connected to an anode of each of the diodes D3 and D4.

The LED's in each of the three groups are connected anode to cathode for current flow in one direction. A cathode of the LED LED1 is connected through the single pole switch A to the second output terminal O2 and an anode of the LED LED5 is connected through the resistor R1 to the first output terminal O1. A cathode of the LED LED6 is connected through the single pole switch C to the second output terminal O2 and an anode of the LED LED10 is connected through the resistor R2 to the first output terminal O1. A cathode of the LED LED11 is connected to the second output terminal O2 and an anode of the LED LED15 is connected through the resistor R3 to the first output terminal O1. The single pole switch B is connected between the cathode of the LED LED1 and the anode of the LED LED10 and the single pole switch D is connected between the cathode of the LED LED6 and the anode of the LED LED15.

When a power supply of 120 volts AC (not shown) is connected across the input terminals I1 and I2, the first switch A and the third switch C are opened such that current flows alternately in opposite directions through the resistor R1 and the three groups of LED's in series. Assuming that the resistors have a substantially higher resistance than the LED's, the second resistor R2 and the third resistor R3 are effectively removed from the circuit. In this circuit configuration, the voltage available to light the LED's is divided equally across each group of LED's.

The circuit shown in the FIG. 3 also will operate with a power supply of 24 volts DC. The 24 volts DC power supply (not shown) is connected to the input terminals I1 and I2 with either polarity. The second switch B and the fourth switch D are opened such that current flows in three parallel paths; a first path through the resistor R1 and the first group of LED's, a second path through the resistor R2 and the second group of LED's and a third path through the resistor R3 and the third group of LED's. Thus, the indicating element E according to the present invention can be operated on either of the two most widely available power supply voltages by selecting one of two pairs of switches to be opened.

Figure 4:
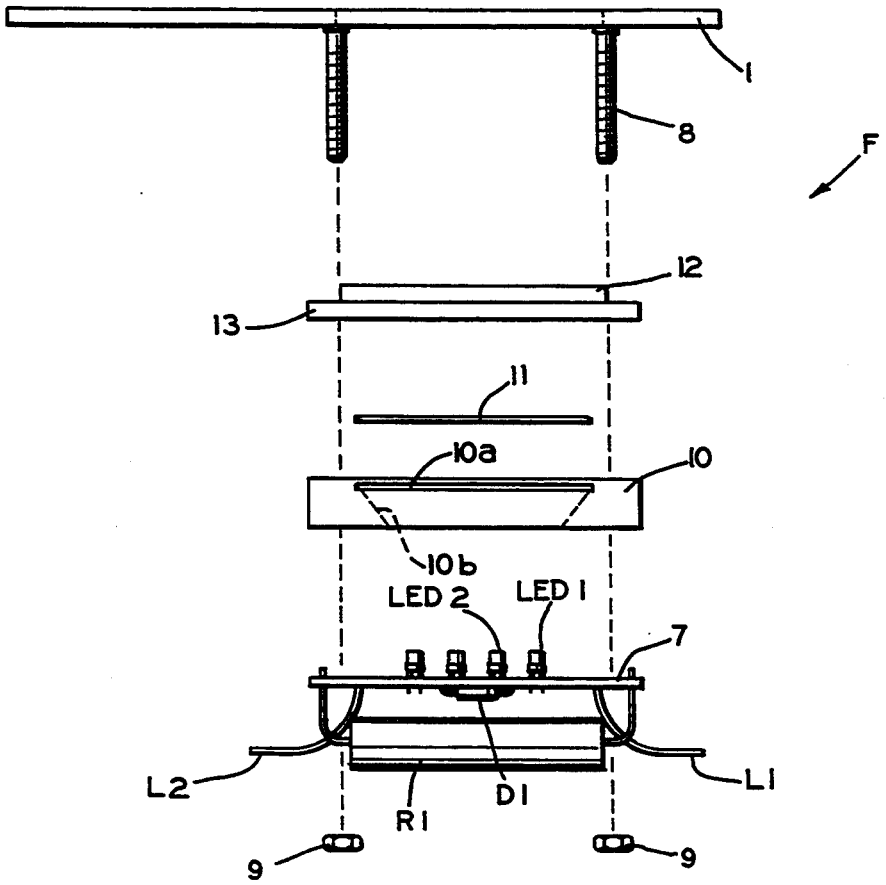
FIG. 4 is an exploded top plan view of an alternate embodiment of the indicating element according to the present invention.

An alternate embodiment the indicating element according to the present invention is shown in the FIG. 4. An indicating element F includes a cover plate 1, a printed circuit board 7, two pairs of studs 8 and two pairs of nuts 9 which are similar to the like numbered parts of the indicating element E. Also, mounted on the printed circuit board are the LED's LED1 through LED15, the diodes D1 through D4, the resistors R1 through R3, the wires L1 and L2, and the switches A, B, C and D connected together in the circuit shown in the FIG. 3. The diffuser 4 of the indicating element E is replaced by a light reflector 10 made of, for example, a white polycarbonate material or white-coated metal material and a generally planar light diffuser 11. The diffuser 11 can be opaque except in the area where a symbol is to be presented wherein the diffuser is transparent. The reflector 10 can have a recess 10*a* formed in a front surface thereof for retaining the diffuser 11. The recess 10*a* and the diffuser 11 can be shaped like a symbol to be displayed such as the arrow shape of the body 5 shown in the FIG. 2. The reflector 10 also has a tapered cavity 10*b* formed therein from the recess 10*a* to the rear surface for receiving the LED's, the recess 10*a* and the cavity 10*b* being surrounded by side walls of the reflector 10. A stepped, generally planar lens 12 closes the indicating element F at the opening in the cover plate 1 and abuts the rear surface 1*b* with an outwardly extending flange 13.

The lenses 2 and 12, the light diffusers 4 and 11, the reflector 10 and the printed circuit board 7 can vary in size and shape depending on the application and the symbols to be presented. Accordingly, the light emitting diodes LED1 through LED15 can be arranged on the printed circuit 7 in a distributed manner to best provide uniform lighting of the symbol. The indicating elements E and F are modular in construction since each of the lenses 2 and 12, the light diffusers 4 and 11, the reflector 10 and the printed circuit board 7 are removably retained on the studs 8 and can be easily replaced to provide for different symbols and different colors of light.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an indicating device for elevators, having at least one light emitting diode for indicating information mounted on a front surface of a printed circuit board and a lens positioned in front of the printed circuit board through which light generated by the light emitting diode is transmitted to a passenger, the improvement comprising: means for guiding light from the light emitting diode to the lens and for forming the light into a symbol to be displayed through the lens, a plurality of light emitting diodes mounted on the front surface of the printed circuit board, at least two of said light emitting diodes being connected together in a first group and at least two other ones of said light emitting diodes being connected together in a second group, and switch means for selectively connecting said first and second groups of light emitting diodes in series to a higher voltage power supply and in parallel to a lower voltage power supply.

2. The indicating device according to claim 1 wherein said means for guiding light includes a white reflective material coating on the front surface of the printed circuit board and a diffuser positioned between the printed circuit board and the lens, said diffuser having side walls extending about the light emitting diode and coated with a white reflective material.

3. The indicating device according to claim 1 wherein said means for guiding light includes a diffuser positioned between the printed circuit board and the lens, said diffuser being formed of a transparent polycarbonate material having a white tint and having side walls extending about the light emitting diode.

4. The indicating device according to claim 1 wherein said means for guiding includes a reflector and a diffuser positioned between said printed circuit board and the lens, said reflector having side walls surrounding a cavity into which the light emitting diode extends.

5. The indicating device according to claim 4 wherein said reflector is formed of a white polycarbonate material.

6. The indicating device according to claim 4 wherein said reflector is formed of a white coated metal material.

7. The indicating device according to claim 4 wherein said reflector, said diffuser and the lens are each generally planar.

8. The indicating device according to claim 4 wherein the printed circuit board, said reflector, said diffuser and the lens are releasably mounted on at least a pair of studs extending from a rear surface of a cover plate.

9. The indicating device according to claim 1 wherein said light emitting diodes emit light having a wavelength of approximately 590 nm.

10. An indicating device for elevators comprising:

a printed circuit board having a front surface;

a plurality of light emitting diodes for indicating information mounted on said front surface of said printed circuit board, a first plurality of said light emitting diodes being connected together in a first group, a second plurality of said light emitting diodes being connected together in a second group and a third plurality of said light emitting diodes being connected together in a third group;

a first switch means for connecting said first, second and third groups in series to a power supply;

a second switch means for connecting said first, second and third groups in parallel to the power supply;

a diffuser positioned in front of said light emitting diodes for guiding light from said light emitting diodes and for forming the light into a symbol to be displayed; and a lens positioned in front of said diffuser through which the light in the form of a symbol is transmitted to a passenger.

11. The indicating device according to claim 10 wherein said first and second switch means are mounted on said printed circuit board.

12. The indicating device according to claim 10 including a full wave rectifier bridge circuit having a pair of input terminals for connection to a power supply and a pair of output terminals connected to said light emitting diodes and to said first and second switch means for connecting said groups in series to light said light emitting diodes when an alternating current power supply is connected to said input terminals and for connecting said groups in parallel to light said light emitting diodes when a direct current power supply is connected to said input terminals.

13. A modular indicating device for elevators comprising:

a cover plate having an opening formed therein and including a rear surface having means for mounting attached thereto;

a source of light removably mounted on said means for mounting facing said rear surface of said cover plate for generating light;

a lens positioned between said source of light and said cover plate at said opening through which said light generated by said source of light is transmitted to a passenger, said lens being removably mounted on said means for mounting and abutting said rear surface of said cover plate; and diffuser means through which said light from said source of light is transmitted to said lens, said diffuser means forming said light into a symbol to be displayed through said lens, said diffuser means being removably mounted on said means for mounting between and abutting said lens and said source of light whereby each of said source of light, said diffuser means and said lens can be removed from said means for mounting and separately replaced by another source of light, another diffuser means and another lens respectively for changing a shape of said symbol as observed by the passenger by replacing said diffuser means and for changing a color of said symbol as observed by the passenger by replacing one of said light source, said diffuser means and said lens.

14. The modular indicating device according to claim 13 wherein said source of light includes a printed circuit board having a front surface and being removably mounted on said means for mounting with said front surface of said printed circuit board facing said rear surface of said cover plate and a plurality of light emitting diodes for generating said light mounted on said front surface of said printed circuit board.

15. The modular indicating device according to claim 14 including means for selectively connecting said light emitting diodes to a high voltage power supply and a low voltage power supply, said means for selectively connecting being mounted on said printed circuit board.

16. The modular indicating device according to claim 13 wherein said lens has a closed forward end extending into said opening and an open rearward end and said diffuser means has a closed forward end, an open rearward end abutting said source of light and side walls extending between said forward and rearward ends, said diffuser means extending into said open rearward end of said lens.

17. The modular indicating device according to claim 13 wherein said diffuser means includes a generally planar light diffuser and a light reflector having means for retaining said light diffuser, said light reflector abutting said source of light for guiding said light to said light diffuser.

18. The modular indicating device according to claim 13 wherein said light diffuser is generally opaque with a transparent area forming said symbol.

19. The modular indicating device according to claim 13 wherein said diffuser means has a light reflective inner surface.

20. The modular indicating device according to claim 13 wherein said diffuser means is shaped like said symbol.

* * * * *